US007321281B2

(12) United States Patent
Molyneux et al.

(10) Patent No.: US 7,321,281 B2
(45) Date of Patent: Jan. 22, 2008

(54) HERMETICALLY SEALED RELAY HAVING LOW PERMEABILITY PLASTIC HOUSING

(75) Inventors: Mike Molyneux, Santa Barbara, CA (US); Scott Hickman, Ventura, CA (US)

(73) Assignee: Gigavac LLC, Carpenteria, CA (US)

( * ) Notice: Subject to any disclaimer, the term of this patent is extended or adjusted under 35 U.S.C. 154(b) by 0 days.

(21) Appl. No.: 11/131,781

(22) Filed: May 17, 2005

(65) Prior Publication Data

US 2006/0261916 A1 Nov. 23, 2006

(51) Int. Cl.
*H01H 13/04* (2006.01)

(52) U.S. Cl. ..... 335/202

(58) Field of Classification Search ..... 335/78–86, 335/124, 128, 151–154, 201, 202; 200/202.1
See application file for complete search history.

(56) References Cited

U.S. PATENT DOCUMENTS 4,039,984 A 8/1977 DeLucia et al. ..... 335/151
4,168,480 A 9/1979 DeLucia ..... 335/151
4,880,947 A 11/1989 Fey et al. ..... 200/144 B
5,162,627 A * 11/1992 Dufournet et al. ..... 218/62
5,554,963 A 9/1996 Johler et al. ..... 335/151
5,990,440 A * 11/1999 Yamaguchi et al. ..... 218/158
6,265,955 B1 * 7/2001 Molyneux et al. ..... 335/128
6,473,289 B1 10/2002 Weisse et al. ..... 361/283.1
6,673,463 B1 * 1/2004 Onishi et al. ..... 428/480

OTHER PUBLICATIONS

Eval Americas, Eval C109 Data Sheet, Dec. 2004.
Comet, Variable Gas Capacitors, X-Cap Slimline Series 2004.

* cited by examiner

*Primary Examiner*—Ramon M. Barrera
(74) *Attorney, Agent, or Firm*—Koppel, Patrick, Heybl & Dawson

(57) ABSTRACT

A high voltage relay comprises a hermitically sealed housing made of ethylene vinyl alcohol (EVOH) and having internal components for changing the state of said relay. Terminals are electrically connected to the internal components for connection to external circuitry and applying an electrical signal to control the state of the relay. A nitrogen and sulfur hexafluoride gas fills the housing to allow for reliable high voltage operation with the housing having low permeability to the molecules of the gas.

17 Claims, 6 Drawing Sheets

FIG. 1
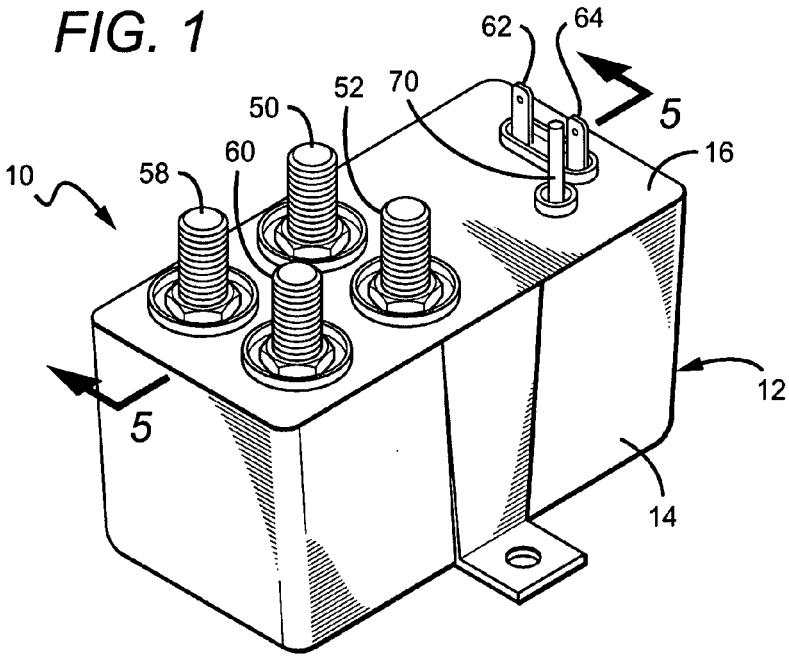
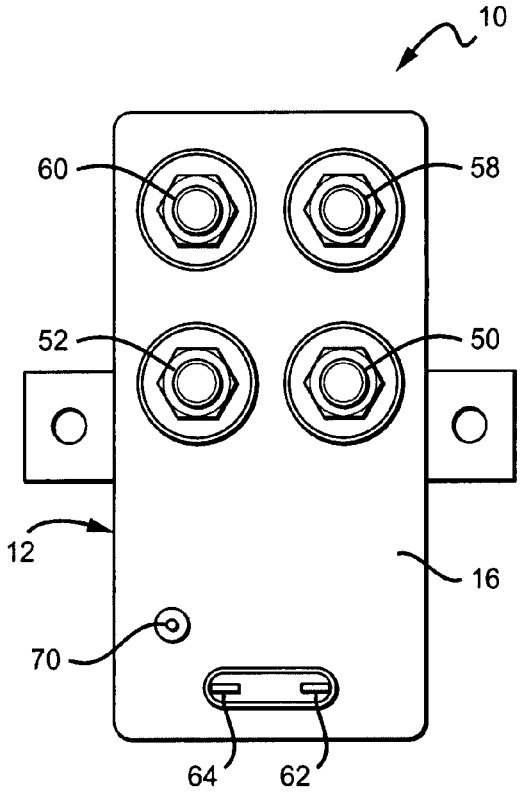
FIG. 3
FIG. 2
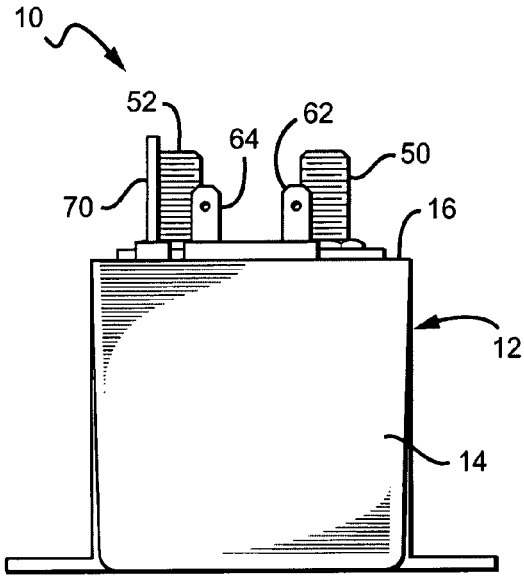

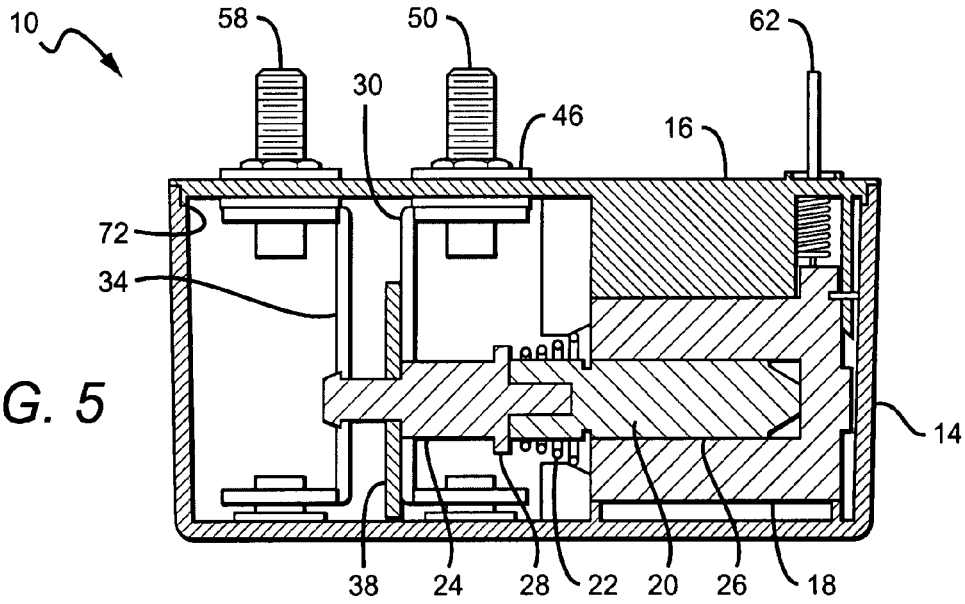
FIG. 5
FIG. 6
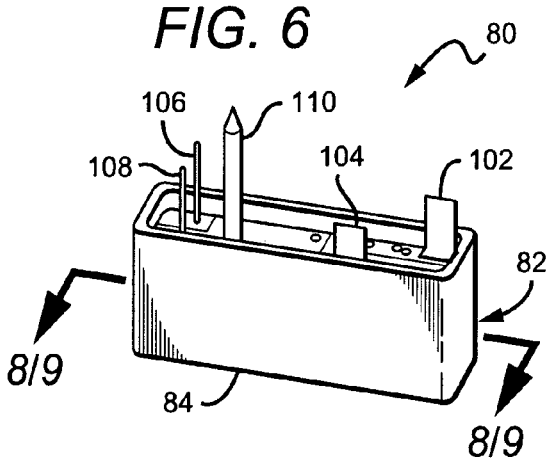
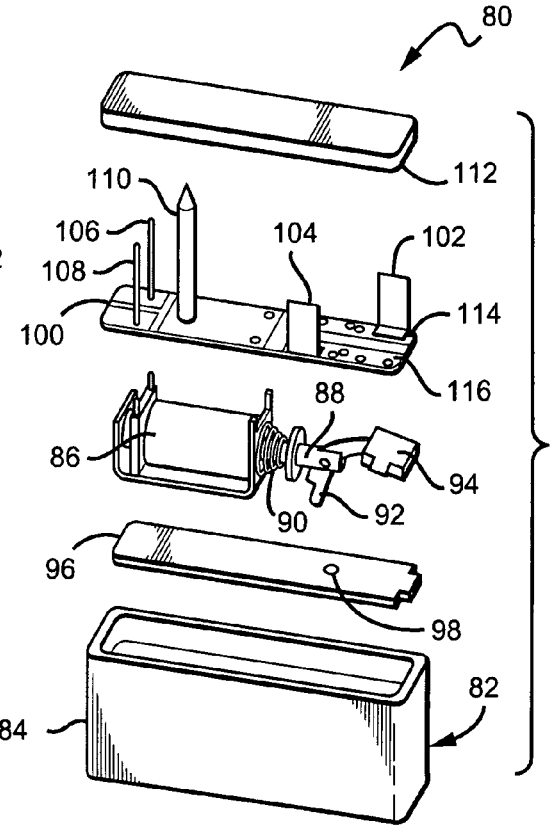
FIG. 7

FIG. 10
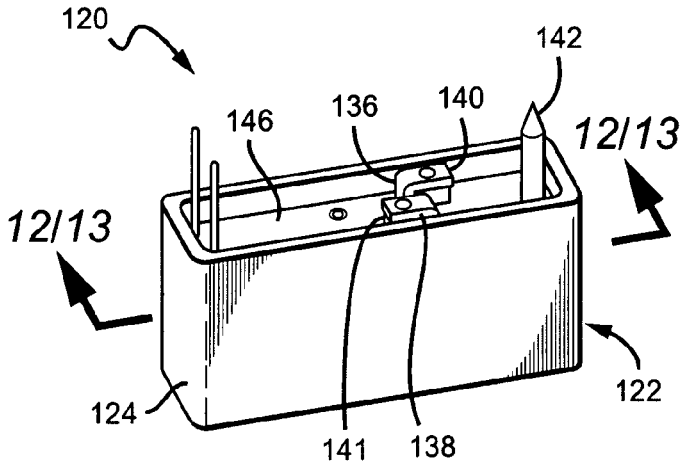
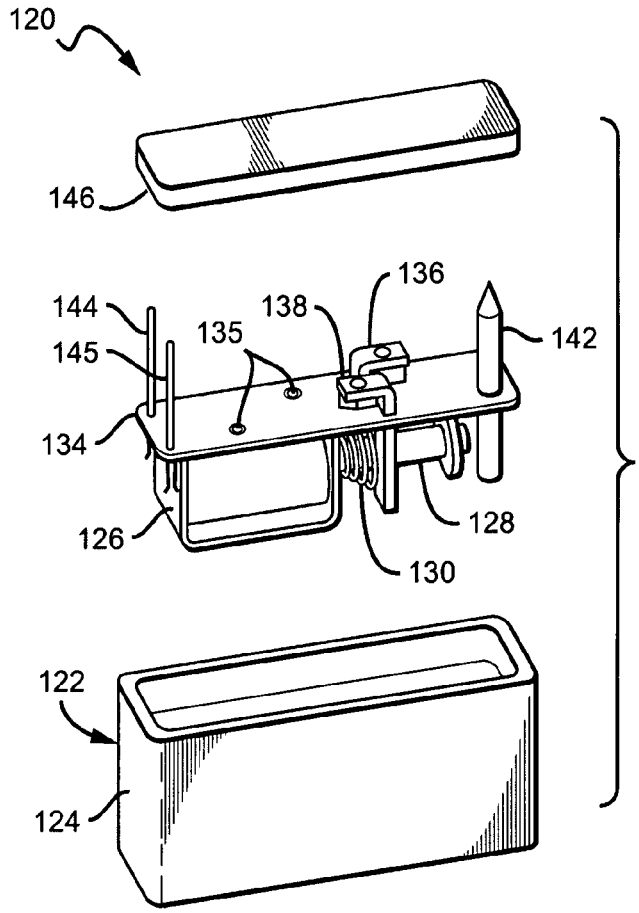
FIG. 11

HERMETICALLY SEALED RELAY HAVING LOW PERMEABILITY PLASTIC HOUSING

BACKGROUND OF THE INVENTION

1. Field of the Invention

The present invention relates to sealed relays, and particularly to high voltage operation sealed relays in low permeability plastic housings.

2. Description of the Related Art

Hermetically sealed electromagnetic relays are used for switching of high electrical currents and/or high voltages, and typically have fixed and movable internal contacts, and an internal actuating mechanism supported within a hermetically sealed housing. In one type of relay air is removed from the relay housing to create a vacuum that suppresses arc formation, provides long operating life and allows for low resistance operation of the relay. In another type of relay, the evacuated chamber can be backfilled under pressure with an insulating gas, which allows the relay to operate with good arc-suppressing properties.

One type of conventional relay has moving components housed within a ceramic housing. These types of relays can operate effectively with a vacuum formed in the housing or with the housing having internal pressure from an injected gas. This allows the relays to operate with high voltage and/or low resistance characteristics and ceramic housings also allow the relays to operate at high temperature. Ceramic housings, however, are typically expensive, difficult to manufacture and offer limited flexibility in the shape and variety of use.

U.S. Pat. No. 4,039,984 to DeLucia et al. generally discloses a high-voltage magnetic relay enclosed within a housing of insulating material which contains a gas, such as sulfur hexafluoride. The terminals within the housing extend through its wall and are secured to and sealed to the housing to prevent gas from leaking from the housing. Leads are connected to the terminals externally of the housing, with insulating material surrounding the leads and being secured by the terminals to the housing. An operating mechanism within the housing shifts a pivoted arm electrically connected to one of the terminals within the housing into and from contact with another of the terminals within the housing. The housing is made from a material that has high impact strength and high heat resistance such as a polyamide or polycarbonate resins.

U.S. Pat. No. 4,168,480 to DeLucia discloses a high voltage magnetic relay that is enclosed by an insulating housing containing a gas, such as sulfur hexafluoride, under pressure. The switch terminals removably extend through a wall of the housing and are sealed. The magnet relay structure is removably connected to the housing by a sealed joint. A fill valve extends through a wall of the housing and is sealed to the housing. The armature shifts a pivotal arm in the housing between open and closed contact positions. The housing is formed of a polyamide material that is resistant to deterioration by fluorine gas, the material being poly hexamethylene terephthalic amide.

U.S. Pat. No. 5,554,963 to Johler et al. discloses a relay that includes a plastic enclosure, contacts disposed in the plastic enclosure for selectively operating to make and/or break at least one electrical connection, a gas filling containing at least one electronegative gas, and a sealed plastic encapsulation for preventing the at least one electronegative gas from diffusing away. The electronegative gases are not utilized at high pressure, but under atmospheric pressure or slightly higher pressure. Since normal pressure is used, a hermetically sealed encapsulation can be dispensed with and the enclosure can be made of low-cost plastics without connection to the outside air.

U.S. Pat. No. 6,265,955 to Molyneux et al. generally discloses a relay having a primary external sidewall formed by a plastic potting cup with a sealed chamber arranged within the cup and having the relay's moving components. The cup is enclosed at the bottom by a base, with the base and cup serving as a mold to hold epoxy material poured into the cup and cured to provide a hermetic seal. Insulated electrical leads extend through the epoxy material from the sealed chamber for connection of fixed and movable contacts to external circuitry. The base can have a threaded portion that extends from the underside of cup. The potting cup is preferably formed of Nylon 6/6.

SUMMARY OF THE INVENTION

The present invention provides high voltage relays that are less expensive, easier and more flexible to manufacture, yet still exhibit long life and reliable high voltage operation. One embodiment of a high voltage relay according to the present invention comprises a hermetically sealed housing having internal components for changing the state of said relay. Terminals are included that are electrically connected to the internal components for connection to external circuitry and for applying an electrical signal to control the state of the relay. A gas fills the housing to allow for reliable high voltage operation, with the housing made of a plastic that is substantially not permeable to the gas.

Another embodiment of a high voltage relay according to the present invention, comprises a hermetically sealed housing made of ethylene vinyl alcohol and having internal components for changing the state of said relay. Terminals are electrically connected to the internal components for connection to external circuitry and applying an electrical signal to control the state of the relay. A gas fills the housing to allow for reliable high voltage operation with the housing substantially not permeable to the molecules of the gas.

These and other further features and advantages of the invention would be apparent to those skilled in the art from the following detailed description, taking together with the accompanying drawings, in which:

BRIEF DESCRIPTION OF THE DRAWINGS

FIG. 1 is a perspective view of one embodiment of a sealed relay according to the present invention;

FIG. 2 is an end elevation view of the relay in FIG. 1;

FIG. 3 is a plan view of the relay in FIG. 1;

FIG. 5 is a sectional view of the relay in FIG. 1 taken along section lines 5-5;

FIG. 6 is a perspective view of another embodiment of a relay according to the present invention;

FIG. 7 is a perspective exploded view of the relay in FIG. 6;

FIG. 10 is a perspective view of still another embodiment of a relay according to the present invention;

FIG. 11 is a perspective exploded view of the relay in FIG. 10;

DETAILED DESCRIPTION OF THE INVENTION

The present invention provides high voltage relays that are housed primarily in a low permeability plastic housing. This allows the housing to be manufactured using low cost materials and processes, such as injection molding, while still providing a housing that can be gas filled under pressure to provide reliable high voltage operation. The low permeability of the plastic used for the housing also provides for low cost manufacturing while still allowing the housing to retain its high pressure gas through a long life cycle. The invention below is described in relation to different embodiments of relays according to the present invention, but it is understood that the invention can be used with other relays or devices and that the relays below can have different components arranged in different ways.

It will be understood that when an element or component is referred to as being "on", "connected to", "coupled to" or "in contact with" another element or component, it can be directly on, connected or coupled to, or in contact with the other element or component or intervening elements or components may be present. In contrast, when an element is referred to as being "directly on," "directly connected to", "directly coupled to" or "directly in contact with" another element or component, there are no intervening elements or components present.

FIGS. 1-5 show one embodiment of a high voltage relay 10 according to the present invention comprising a housing 12 having a bucket 14 and a lid 16. The relay's internal moving components are mounted to the lid 16 as further described below and the lid 16 is sized and arranged to mate with and mount to the top opening of the bucket 14 such that there is a hermetic seal between the two. The relay's internal moving components are held in the sealed internal chamber defined by the lid 16 and the bucket 14. As further described below, the bucket 14 and lid 16 internal chamber can be filled with gas by an air tube that passes through the lid 16. The relay's internal components are also contacted through the lid 16. Operation of relays is generally known in the art and is only briefly discussed with reference to the different components in relay 10.

Figure 4:
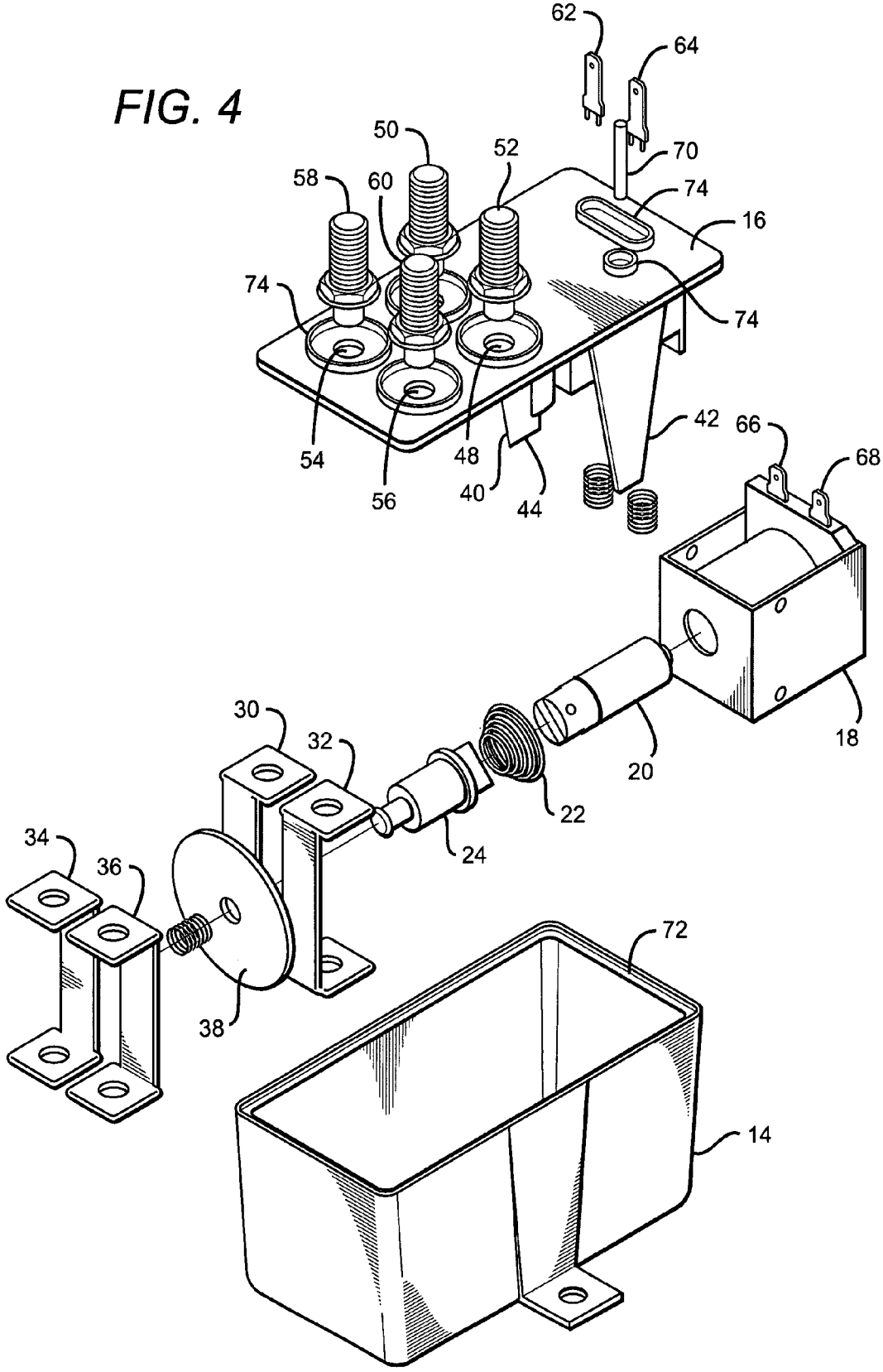
FIG. 4 is a perspective exploded view of the relay in FIG. 1.

FIGS. 4 and 5 show the relay's internal components, which include a mechanism for changing the state of the relay, with a preferred mechanism being a solenoid 18. Many different solenoids can be used, with a suitable solenoid operating under a low voltage and with a relatively high force solenoid such as commercially available solenoid Model No. SD1564 N1200, from Bicron Inc. The internal components further comprise a plunger 20, a plunger spring 22 and a shaft 24. Most of the plunger 20 is arranged within solenoid 18 with a small portion protruding from the solenoid opening 26. The shaft 24 is connected to the protruding end of the plunger 20 with the plunger spring 22 held between the solenoid and the shaft's radial lip 28. When the solenoid 18 is energized, the plunger 20 is drawn fully into the solenoid and the plunger spring 22 is compressed between the solenoid 18 and the lip 28. When the solenoid is not energized, the plunger is urged by the spring 22 to extend at least partially from the solenoid 18.

First and second contact brackets 30, 32 are mounted vertically within the housing 12 with the shaft. 24 passing between them. Opposing third and fourth brackets 34, 36 are also mounted vertically within the housing 12. A contact ring 38 is mounted to the end of the shaft 24 in the space between the first and second brackets 30, 32 and the third and fourth brackets 34, 36. When the solenoid 18 is energized and the plunger 20 is drawn into the solenoid 18 the contact ring 38 is drawn into contact with the first and second brackets 30, 32, providing a conductive path between the two. When the solenoid 18 is not energized the contact ring 38 is urged in contact with the third and fourth brackets 34, 36 under the action of the plunger spring 22, providing a conductive path between the two.

The lid 16 comprises first and second arms 40, 42 extending toward the bottom of the bucket 14 and each having an inward directed arm tab 44. The solenoid 18 is held by the arms 40, 42 between the underside of the lid 16 and the tabs 44. The lid 16 also has first and second terminal holes 46, 48 sized so that first and second terminals 50 and 52 can pass through the lid 16 to make electrical contact with the first and second brackets 30, 32, respectively. Similarly, the lid 16 has third and fourth holes 54, 56 sized so that third and fourth terminals can pass through the lid 16 to make contact with the third and fourth brackets 34, 36, respectively. The lid 16 also has first and second solenoid terminals 62, 64, at least a portion of which pass through the lid 16 to make contact with the first and second solenoid contact 66, 68. The lid also has an air tube 70 that is arranged to allow gasses to be injected into the housing, preferably under pressure. In other embodiments, the tube. 70 can be used to create a vacuum in the housing 12. After the gasses are injected (or vacuum created) the tube is crimped or plugged so that no further gasses can pass in or out. Different gasses can be injected in the housing such as sulfur hexafluoride or mixture of nitrogen and sulfur hexafluoride.

Pursuant to the present invention, the bucket 14 and lid 16 are preferably made of a material having low or substantially no permeability to the gas injected into the housing, with a preferred material being a low permeability plastic or polymer. It is understood in the art that permeability is a mechanism of absorption of the gas into the plastic, diffusion of the gas through the plastic, and finally desorption and evaporation of the gas from the plastic into the surrounding ambient. Different plastic can have different permeability rates for different types of gasses. For example, a plastic may have lower permeability to $O_2$ compared to other gasses such as $H_2O$, with the permeability rate being primarily related to the size of the gas molecules, the structure of the plastic and its ability to resist gas absorption, diffusion and desorption.

As described above, many different gasses can be injected into the housing 12, and for different gasses different plastics may exhibit low permeability. The preferred injected gas is a mixture of nitrogen and sulfur hexafluoride, and the nitrogen molecule is comparable to the size of an oxygen molecule such that a plastic having low permeability to oxygen also exhibits low permeability to the nitrogen and sulfur hexafluoride mixture. Many different plastics can be used according to the present invention such as commercially available polyvinylidene chloride (PVDC), nylon and polyethylene terephthalete (PET), with a preferred plastic being ethylene vinyl alcohol (EVOH), which exhibits the lowest permeability rate to oxygen and nitrogen sulfur hexafluoride gas. Like other plastics, devices can be manufactured from EVOH by injection molding, which allows for low cost manufacturing compared to conventional glass or ceramic relays. This allows for mass production of relays having many different shapes and sizes and allows for cost effective manufacturing of custom relays. EVOH also has a relatively high tensile strength of approximately 9000 pounds per square inch (psi), which is comparable to many generally accepted engineering plastics, such as polycarbonates. EVOH, however, is relatively brittle and as such, the housing design should typically avoid sharp corners that can create stress concentrations.

Although the plastics above exhibit low permeability to the injected gasses, they typically cannot be effectively used for relays having a vacuum in their housing. Plastics typically outgas over time. That is, plastics can release gasses from the elements comprising the plastic, particularly under a vacuum. This release can in turn contaminate the air within the housing or other gasses injected into the housing. The plastic housing, however, can be gas filled to a relatively high pressure, such as 50 psi or higher. Accordingly, the relays according to the present invention are particularly applicable to high voltage operation under high pressure, but are not as effective for low resistance operation under a vacuum.

Conventional glass and ceramic housed relays can also operate with higher temperatures compared to plastic housed relays. As a result, plastic housed relays are typically used in lower operating and storage temperature applications. Particular attention should be paid to the design of plastic housed relays to allow for soldering of terminals.

To provide a hermetically sealed housing 12, the bucket 14 is arranged with an internal lip 72 around the inside edge of its opening. The lid 16 is sized to rest on the lip 72. During manufacturing, an epoxy bead is injected onto the lip 72 and the lid 16 is placed on the lip 72 with the epoxy holding the lid 16 on the lip 72 and forming a hermetic seal between the bucket 14 and the lid 16. Wells 74 are included around each of the terminals 50, 52, 58, 60, 66, 68 and the air tube 70, each of which can be filled with a low permeability epoxy to ensure that a hermetic seal is formed at each of the holes through the lid 16. Different epoxies can be used, with a suitable epoxy being commercially available under Emerson and Cummings Stycast Black No. 2651-1, or EV Roberts RF 5407.

As described above, the solenoid 18 can be energized by applying the appropriate bias to the first and second solenoid terminals 66, 68, with the energized solenoid drawing the contact ring 38 into contact with the first and second brackets 30, 32. When the solenoid 18 is not energized the contact ring 38 is urged in contact with the third and fourth brackets 34, 36 under the action of the plunger spring 22, providing a conductive path between the two. This allows the relay 10 to have two states, the first with a conductive path across the first and second brackets 30, 32, and the second with a conductive path across the third and fourth brackets 34, 36. The relay 10 has exhibited operation in the 300-1000 volt range and it is expected that it will be capable of operating at 10,000 volts and above, taking into consideration operating temperatures.

FIGS. 6-9 show another embodiment of a high voltage relay 80 according to the present invention comprising a housing 82 having a bucket 84 to hold the relay's moving components. Similar to the relay 10 described above with FIGS. 1-5, the relay 80 comprises a solenoid 86 having a plunger 88 and a plunger spring 90. The plunger 88, however, has a lever 92 connected to the end extending from the solenoid 86, with the lever 92 having a conductive contact 94 at one end. Rectangular plate 96 is included between the solenoid 86 and the bottom of the bucket 84, with the plate 96 being made of many different materials such as plastic. The plate 96 has a lever hole 98 with the end of the lever 92 opposite the contact 94 inserted into the hole 98. A circuit board 100 is included in the bucket 84, on top of the solenoid 86, with the solenoid 86 sandwiched between the circuit board 100 and the plate 96. The circuit board 100 can comprise conventional circuit board materials, and includes first and second operating terminals 102, 104 for connection during use of the relay 80 as is known in the art. The circuit board 100 also comprises first and second solenoid terminals 106, 108 for contacting and applying a signal to the solenoid during operation. An air tube 110 is also included on the circuit board to inject gasses into the housing, with the air tube 110 crimped or otherwise sealed after injection of the gasses.

The plate 96 is arranged within the bucket 84 below its top edge, providing a reservoir 111 for holding a layer of sealing material 112 such as one of the epoxies described above. The circuit board 100 is covered by the epoxy layer and the epoxy layer 112 forms a hermetic seal with the circuit board 100 and the bucket 84 to form a hermitically sealed housing. According to the present invention, the bucket 84 is formed of a low permeability plastic, and as described above, many different plastics can be used with a preferred plastic being EVOH. By being formed of a plastic, the housing 82 exhibits all the above listed advantages such as easy, flexible and low cost manufacturing, and low permeability to the injected gas. In an alternative embodiment, the epoxy layer 112 can instead be a lid of plastic such as EVOH. The lid can be designed to accommodate the terminals 102, 104, 106, 108 and the air tube 110, and can be affixed to the bucket 84 by an epoxy to form a hermetically sealed housing 82.

As shown in FIG. 7, each of the operating terminals 102, 104 has a respective conductive strip 114, 116 with each of the conductive strips 114, 116 being on both sides of the circuit board 100. The first conductive strip 114 is in contact with the first terminal 102, and the second conductive strip 116 is in contact with the second terminal, with a space between the strips 114, 116. The strips 114, 116 cooperate with the lever's contact 94 to open and close the relay 80.

Figure 8:
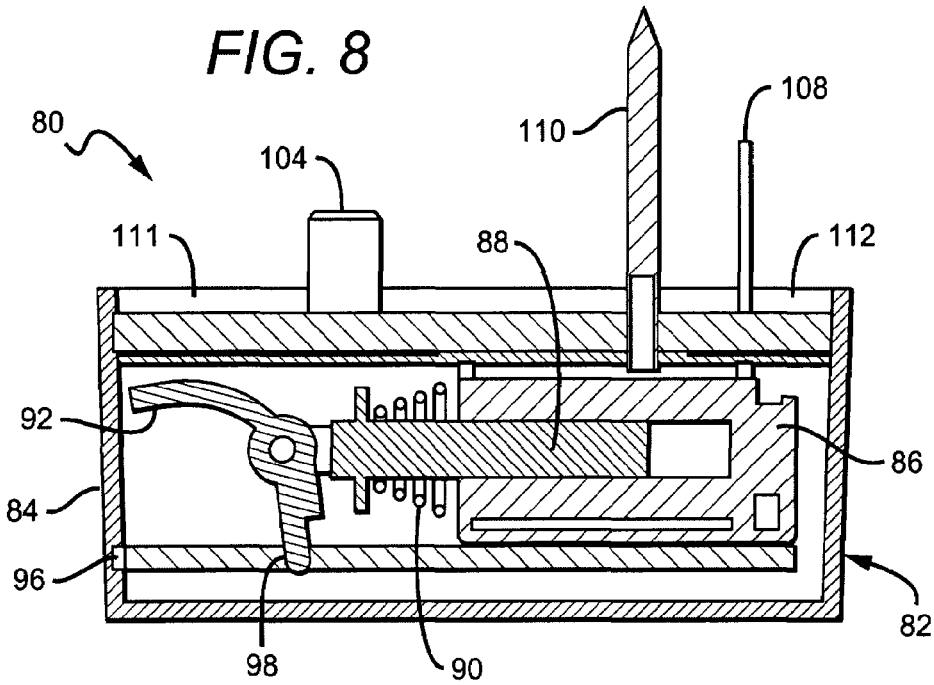
FIG. 8 is a sectional view of the relay in FIG. 6 taken along section lines 7/8-7/8.
Figure 9:
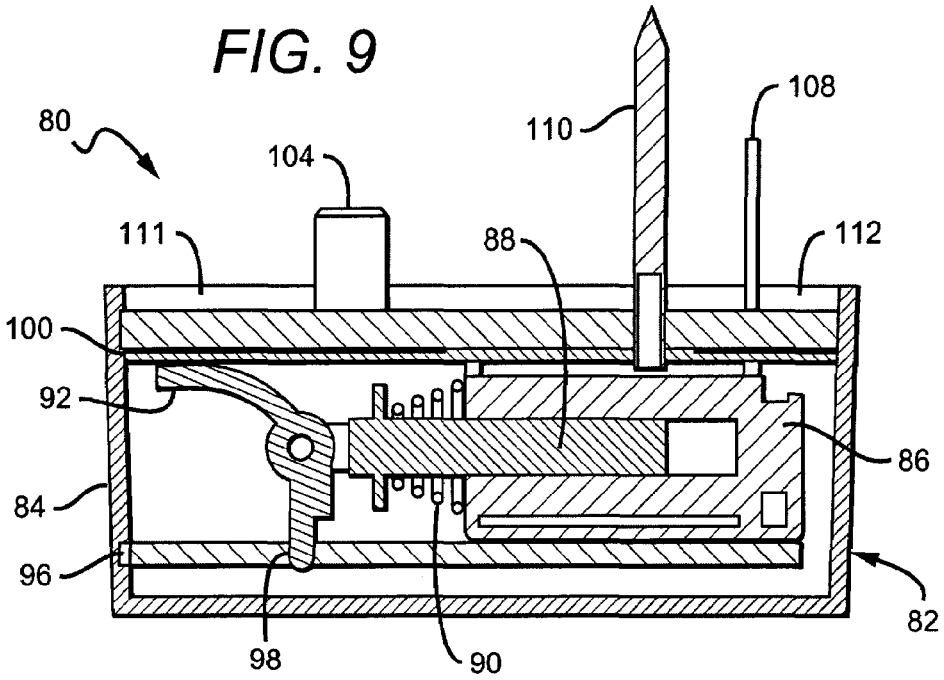
FIG. 9 is also a sectional view of the relay in FIG. 6 taken along section lines 7/8-7/8.

Referring now to FIG. 8 in conjunction with FIG. 7, the relay 80 is shown in a state wherein the solenoid 86 is not energized. The plunger 88 is urged to extend from the solenoid 86 under the force of the plunger spring 90. This action on the plunger 88 is transferred to the lever 92, causing the contact 94 to move away from the circuit board 100 and the conductive strips 114, 116. Referring now to FIG. 9 in conjunction with FIG. 7, the relay 80 is shown with the solenoid 86 energized by a signal applied to the first and second solenoid terminals 106, 108. This draws the plunger 88 into the solenoid against the force of the plunger spring 90, which in turn causes the lever 92 to rotate and push the contact 94 against the strips 114, 116, closing the relay 80. This action also causes the contact 94 to engage the strips 114, 116 in a wiping action with the contact 94 moving along the strips 114, 116 as the strips 114, 116 are contacted. This wiping action allows the contact 94 to break away oxides that may have built up on the strips 114, 116 to provide efficient electrical contact. When the signal is again removed from the solenoid 86, the plunger spring 90 urges the plunger 88 from the solenoid 86, causing the contact 94 to disengage from the conductive strips 114, 116.

FIGS. 10-13 show still another embodiment of a high voltage relay 120 according to the present invention comprising a housing 122 having a bucket 124 to hold the relay's moving components. The bucket 124 also holds a solenoid 126 having a plunger 128 and a plunger spring 130. A circular contact 132 is mounted at the end of the plunger 128 and is arranged to close the relay 120 when the solenoid 126 is energized.

The solenoid 126 is mounted to the underside of a plastic section 134, and many different mounting devices can be used, with a suitable mounting device being screws 135 sized to fit within the bucket 124. The section 134 also holds first and second contact brackets 136, 138 that pass vertically from the topside of the section to the underside, with the plunger 128 passing between the brackets 136, 138. Brackets 136, 138 also have respective horizontal portions 140, 141 that serve as operating terminals for the relay 120. The section 134 also comprises first and second solenoid terminals 144, 145 for applying a signal to the solenoid 126. The terminals 144, 145 at the underside of the section 134 can comprise connectors for making electrical connection with conductors from the terminals to the solenoid 126. Many different connectors can be used, with a preferred connector being an insulation displacement connector (IDC). The section 134 also has an air tube 142 for filling the housing 122 with a gas such as the nitrogen and sulfur hexafluoride gas described above. The air tube 142 is crimped or otherwise sealed after the desired amount of gas is injected into the housing 122.

The section 134 is arranged in the bucket 124 below the bucket's top edge, to form a reservoir 150 (shown in FIGS. 12 and 13) above the section 134. The reservoir is arranged to hold a layer of sealing material 146, such as one of the epoxies described above. The epoxy layer 146 seals to the section 134 and the bucket 124 to provide a hermetically sealed housing 122.

Figure 12:
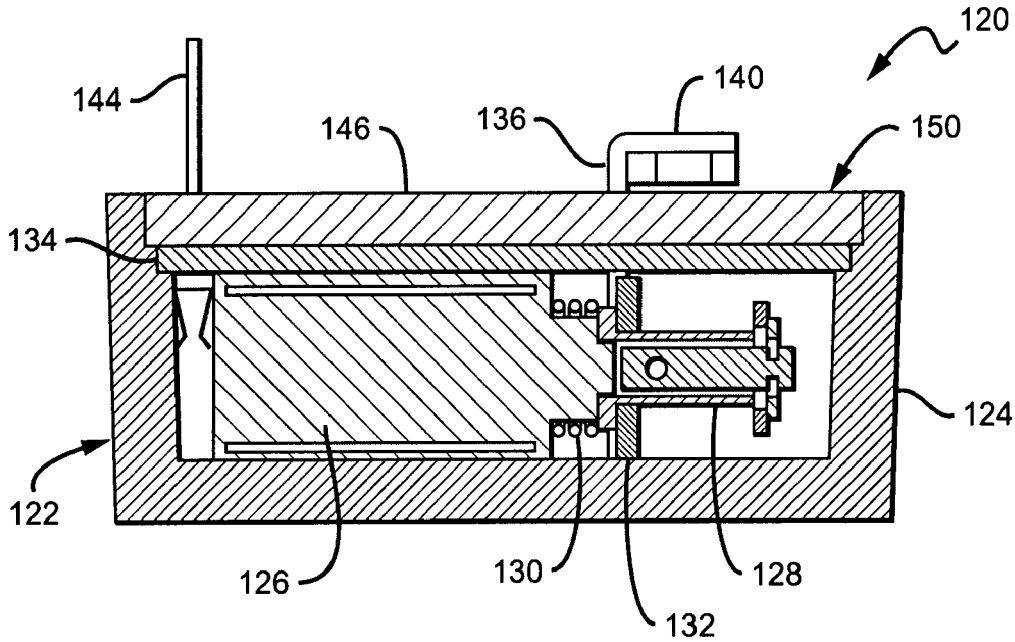
FIG. 12 is sectional view of the relay in FIG. 10 taken along section lines 12/13-12/13.
Figure 13:
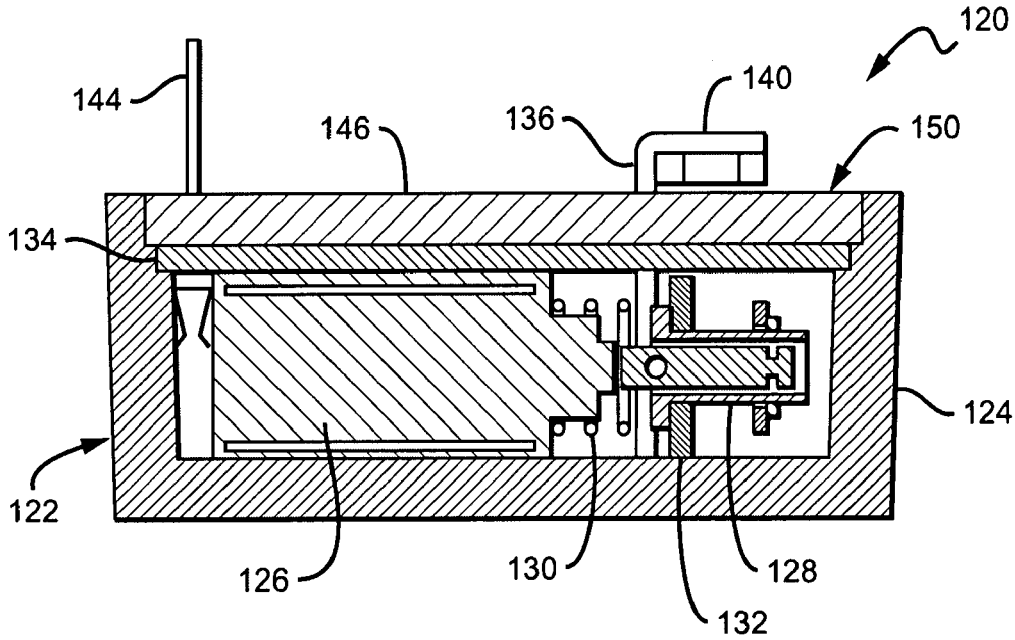
FIG. 13 is a sectional view of the relay in FIG. 10 taken along section lines 12/13-12/13.

In operation, when the solenoid 126 is energized plunger 128 is drawn into the solenoid 126 and the circular contact 132 is drawn in contact with the first and second contact brackets 136, 138, as best shown in FIG. 12. When the solenoid is not energized the solenoid spring urges the plunger to extend from the solenoid 126, S pushing the circular contact 132 away from and out of contact with the brackets 136, 138, as best shown in FIG. 13.

According to the present invention, the bucket 124 is formed of a low permeability plastic, and as described above, many different plastics can be used with a preferred plastic being EVOH. By being formed of a plastic, the housing 124 also exhibits all the above listed advantages such as easy, flexible and low cost manufacturing, and low permeability to the injected gas.

Although the present invention has been described in considerable detail with reference to certain preferred configurations thereof, other versions are possible. The field plate arrangement can be used in many different devices. The field plates can also have many different shapes and can be connected to the source contact in many different ways. The spirit and scope of the invention should not be limited to the preferred versions of the invention described above.

We claim:

1. A high voltage relay, comprising:

a hermetically sealed housing having internal components for changing the state of said relay;

terminals electrically connected to said internal components for connection to external circuitry and applying an electrical signal to control the state of said relay; and a gas filling said housing to allow for reliable high voltage operation, said housing comprising a single type of plastic that is substantially impermeable to said gas, said plastic housing completely enclosing said internal components.

2. The relay of claim 1, wherein said housing further comprises an air tube for injecting gas into said housing.

3. The relay of claim 2, wherein said housing contains gas under pressure.

4. The relay of claim 1, wherein said housing comprises a plastic from the group consisting of polyvinylidene chloride (PVDC), nylon polyethylene terephthalete (PET), and ethylene vinyl alcohol (EVOH).

5. The relay of claim 1, wherein said gas has a molecular size substantially equal to oxygen, said plastic substantially not permeable to oxygen molecules.

6. The relay of claim 1, wherein said gas comprises a mixture of nitrogen and sulfur hexafluoride, said housing substantially not permeable to nitrogen molecules.

7. The relay of claim 6, wherein said housing is made of ethylene vinyl alcohol (EVOH).

8. The relay of claim 1, wherein said housing comprises a bucket for holding said internal components, and a lid covering said bucket with an airtight seal.

9. A high voltage relay, comprising:

a hermetically sealed housing made entirely of ethylene vinyl alcohol and having internal components for changing the state of said relay;

terminals electrically connected to said internal components for connection to external circuitry and applying an electrical signal to control the state of said relay; and a gas filling said housing to allow for reliable high voltage operation, said housing completely enclosing said internal components and substantially impermeable to the molecules of said gas.

10. The relay of claim 9, wherein said gas comprises a mixture of nitrogen and sulfur hexafluoride.

11. The relay of claim 10, wherein said housing is substantially not permeable to molecules of said nitrogen and sulfur hexafluoride gas.

12. The relay of claim 9, wherein said housing further comprises an air tube, said gas injected into said housing through said air tube.

13. The relay of claim 11, wherein said gas is injected into said housing under pressure.

14. The relay of claim 9, wherein said internal components comprise a solenoid controlled by said electrical signal to change the state of said solenoid.

15. The relay of claim 14, wherein said internal components further comprise a lever, said lever cooperating with said solenoid to change the state of said relay.

16. The relay of claim 9, wherein said housing comprises a bucket and a lid, said bucket having an opening and holding said internal components, and said lid covering said bucket opening and mounted to said bucket with an airtight seal to form said hermetically sealed housing.

17. The relay of claim 16, wherein said lid is mounted to said bucket by an epoxy.

* * * * *